United States Patent [19]

Rabitsch

[11] Patent Number: 5,076,497

[45] Date of Patent: Dec. 31, 1991

[54] SPRAY NOZZLE

[76] Inventor: Benjamin F. Rabitsch, P.O. Box 598, Millen, Ga. 30442

[21] Appl. No.: 670,399

[22] Filed: Mar. 15, 1991

Related U.S. Application Data

[63] Continuation of Ser. No. 341,764, Apr. 21, 1989, abandoned.

[51] Int. Cl.[5] ..... B05B 7/30; B05B 1/26

[52] U.S. Cl. ..... 239/310; 239/518; 239/552; 239/590; 239/601; 239/DIG. 1

[58] Field of Search ..... 239/159, 172, 310, 518, 239/521, 524, 552, 589, 590, 597, 598, 601, DIG. 1

[56] References Cited

U.S. PATENT DOCUMENTS

| | | | |
|---|---|---|---|
| 2,204,938 | 12/1935 | Marshall | 239/159 |
| 2,767,022 | 10/1956 | Kennard et al. | 239/521 |
| 2,778,688 | 1/1957 | Corl | 239/601 |
| 2,964,248 | 12/1960 | O'Brien et al. | 239/597 |
| 2,971,250 | 2/1961 | Wahlin | 239/601 |
| 3,017,118 | 1/1962 | Kane | 239/310 |
| 3,473,481 | 10/1969 | Brane | 239/310 |
| 3,563,468 | 2/1971 | Holzinger | 239/310 |
| 3,565,112 | 7/1969 | Sides | 239/310 |
| 4,648,558 | 3/1987 | Rabitsch | 239/601 |

*Primary Examiner*—Andres Kashnikow

*Assistant Examiner*—Karen B. Merritt

*Attorney, Agent, or Firm*—Fleit, Jacobson, Cohn, Price, Holman & Stern

[57] ABSTRACT

A spray nozzle to discharge liquid material in a pattern which has the same quantity of liquid material in each increment of the pattern. The nozzle may be used in various orientations in which a supply of pressurized liquid is available with the liquid being discharged generally in a lateral direction in relation to the path of movement of the nozzle thereby rendering the nozzle quite effective for use in discharging liquid fertilizer, growth retardant, insect sprays, orchard spray material and the like in an effective manner. In one embodiment of the invention, a nozzle is provided with a discharge passageway, a downwardly opening, inverted U-shaped extension of the passageway and a curved blade diffuser in the inverted U-shaped extension of the passageway to break up the liquid flow into droplets and to cause the droplets to be discharged in a lateral pattern so that a substantial equal quantity of liquid material is discharged in each increment of the path being traversed by the nozzle. In another embodiment of the invention, an additive injector is incorporated into the nozzle which enables a controlled quantity of liquid material to be injected into the main flow of liquid being discharged with the diffuser effectively serving as a mixer for the additive and the liquid discharged from the nozzle.

17 Claims, 2 Drawing Sheets

SPRAY NOZZLE

This application is a continuation-in-part, continuation of application Ser. No. 07/341,764, filed Apr. 21, 1989, now abandoend.

BACKGROUND OF THE INVENTION

Field of the Invention

The present invention generally relates to a spray nozzle and more specifically to a nozzle to discharge liquid material in a pattern which has the same quantity of liquid material in each increment of the pattern. The nozzle may be used in various orientations in which a supply of pressurized liquid is available with the liquid being discharged generally in a lateral direction in relation to the path of movement of the nozzle thereby rendering the nozzle quite effective for use in discharging liquid fertilizer, growth retardant, insect sprays, orchard spray material and the like in an effective manner. In one embodiment of the invention, a nozzle is provided with a discharge passageway, a downwardly opening, inverted U-shaped extension of the passageway and a curved blade diffuser in the inverted U-shaped extension of the passageway to break up the liquid flow into droplets and to cause the droplets to be discharged in a lateral pattern with substantially equal quantities of liquid material being discharged in each increment of the path being traversed by the nozzle. In another embodiment of the invention, an additive injector is incorporated into the nozzle which enables a controlled quantity of liquid material to be injected into the main flow of liquid being discharged with the diffuser effectively serving as a mixer for the additive and the liquid discharged from the nozzle.

INFORMATION DISCLOSURE STATEMENT

Spray nozzles of various types are well known for irrigation purposes, discharging fertilizer from a mobile vehicle with a tank and pump assembly and for various other purposes growth retardants and the like. My prior U.S. Pat. No. 4,648,558 issued Mar. 10, 1987 for Sprinkler Assembly discloses a discharge nozzle with a diffuser to provide a spray pattern in which equal quantities of liquid are discharged onto a surface area. This patent and the prior art cited therein relate to various types of sprinkler nozzles or spray nozzles but the prior art does not disclose a nozzle in accordance with the present invention.

SUMMARY OF THE INVENTION

An object of the present invention is to provide a spray nozzle having a body with a passageway therethrough for receiving liquid under pressure with an extension of the passageway being in the form of an inverted, downwardly opening U-shaped passageway provided with a diffuser blade adjacent the outer end thereof to break the stream of liquid into droplets in a manner that the droplets will be discharged over a path of movement of the nozzle with each increment of the pattern covered by the nozzle receiving substantially the same quantity of discharged material.

Another object of the invention is to provide a nozzle which enables a boom spray arrangement to be modified by eliminating normally provided 20 ft. booms or the like which extend laterally from opposite sides of a mobile vehicle having a tank, pressure providing pump and boom with a plurality of nozzles thereon and replacement with two oppositely facing nozzles of this invention for applying liquid laterally of the path of movement of the vehicle with the spray pattern depositing equal amounts of liquid throughout the lateral distance of application of the liquid.

A further object of the invention is to provide a nozzle combined with an injector structure which enables an additive material to be injected into the flow passageway with the diffuser blade mixing the additive material with the liquid passing through the nozzle to provide a homogenous mixture and discharging this mixture in the manner set forth in the preceding objects.

Still another object of the invention is to provide a nozzle in accordance with the preceding objects which can be mounted on the side of a truck to spray growth retardant, weed killer or the like onto road right-of-way areas to reduce the necessity of mowing along road right-of-ways with the nozzle also being capable of being angled upwardly to spray orchard trees and particularly spray the undersurface of the leaves on orchard trees for more effective application of materials to the trees.

Still another feature of the present invention is to provide a nozzle with an additive injector which enables additive material to be discharged from the nozzles without overcoming line pressure in a spray boom thereby enabling additives to be applied under computer control arrangements that may be responsive to infrared survey of organic material present in an area being covered by spray material.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
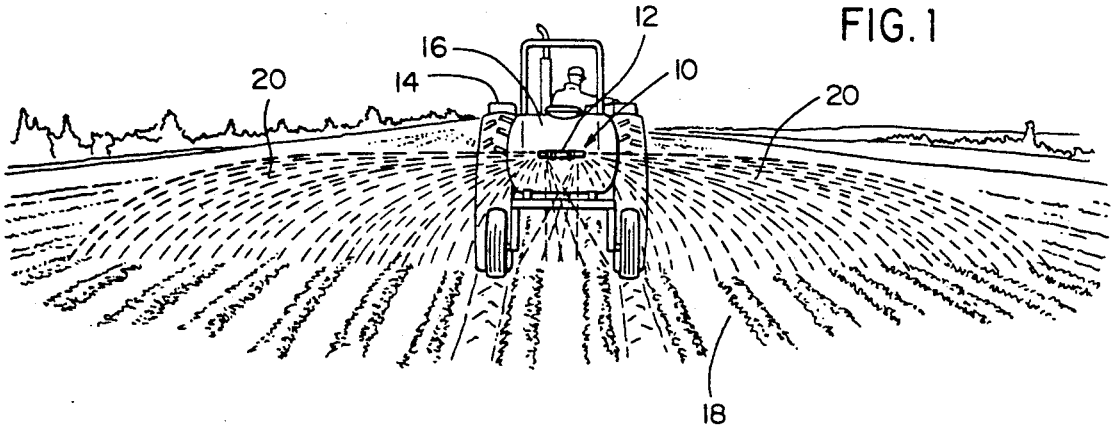
FIG. 1 is a rear elevational view of a spray device illustrating two nozzles of the present invention incorporated therein for discharging a spray pattern laterally to each side of a vehicle.
Figure 2:
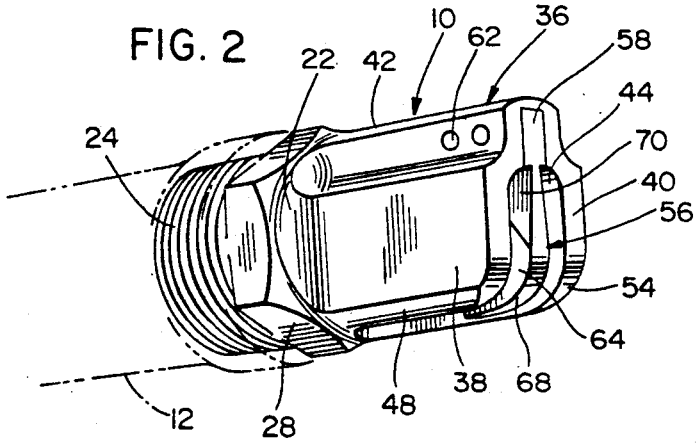
FIG. 2 is a perspective view of the nozzle of this invention.
Figure 3:
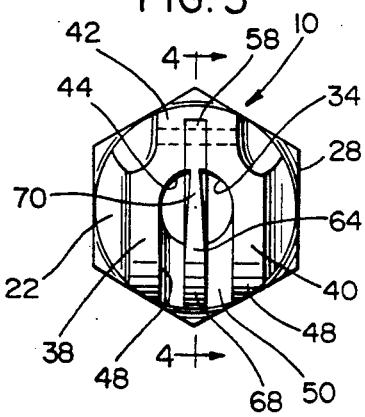
FIG. 3 is an end elevational view of the nozzle.
Figure 4:
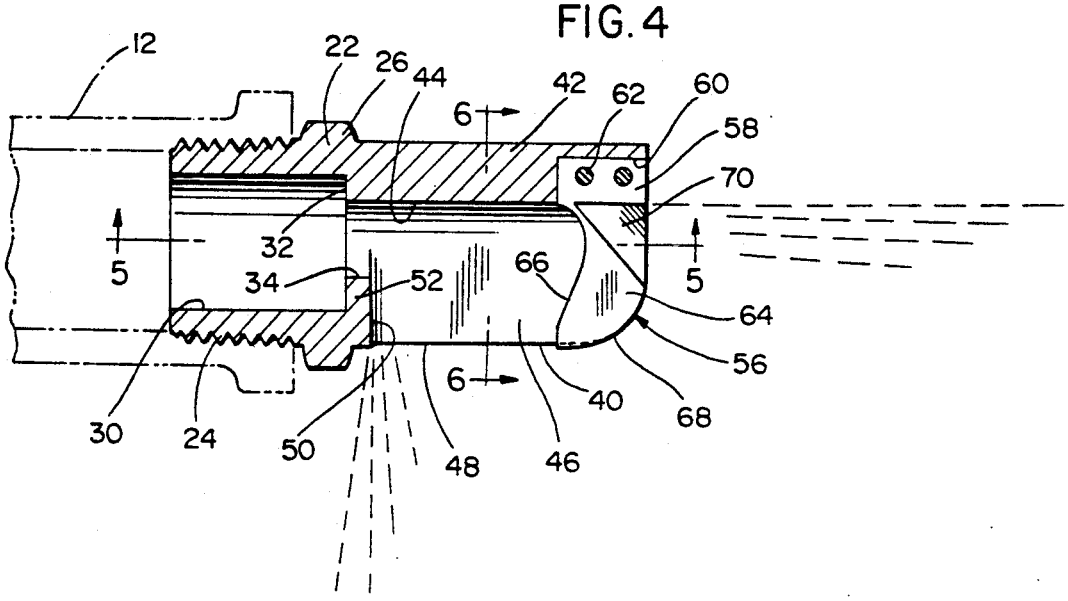
FIG. 4 is a longitudinal, sectional view of the nozzle taken substantially along section line 4—4 on FIG. 3 illustrating the structural details of the nozzle.

The nozzle illustrated in FIGS. 1-6 is generally designated by reference numeral 10 and, as illustrated in FIG. 1, a pair of nozzles 10 are attached to a tee fitting 12 mounted at the rear of a tractor or similar vehicle 14 provided with a supply tank 16 of liquid to be discharged onto the ground surface 18 in both lateral directions in relation to the tractor 14. The tank 16 contains a liquid and a pump (not shown) is utilized to provide a supply of pressurized liquid to the tee fitting and the nozzles 10. The nozzles 10 discharge the liquid material in a laterally extending spray pattern 20 which has overlapping inner portions. The nozzles 10 effectively replace booms which may be 20 ft. in length and extend laterally from the tractor in both lateral directions thereby enabling the booms to be removed along with the multiple spray nozzles employed thereon and this entire assembly replaced by a pair of nozzles 10 attached directly to the tee fitting 12. The nozzle 10 includes a body 22 of tubular construction that is provided with an externally threaded end portion 24 for mounting in the end of the tee fitting 12 or other pipe. The body 22 is provided with an enlarged flange 26 with flats 28 thereon by which a wrench can be used to secure the nozzle 10 in place on the tee fitting 12 in a well-known manner. The end of the body 22 that is inserted into the tee fitting is provided with an enlarged recess or passageway 30 that extends a substantial distance into the body and terminates in a shoulder 32 having a passageway 34 formed therein at the center with the passageway 34 being of circular configuration but smaller in diameter than the passageway 30 as illustrated in FIG. 4.

Extending longitudinally from the body 22 is an extension of the body generally designated by numeral 36 which basically is an inverted U-shaped member provided with a pair of oppositely disposed walls 38 and 40 which are spaced apart at the bottom edge and connected by a web portion 42 at the upper edge with the interior of the web portion 42 being designated by numeral 44 and forming a continuation of the upper surface of the passageway 34. The interior parallel surfaces 46 of the walls 38 and 40 are tangential to the side edge portions of the passageway 34 as illustrated in FIG. 3 with the lower edges 48 of the walls 38 and 40 extending downwardly below the lower edge of the passageway. As illustrated, the wall surfaces 46 are parallel and spaced apart a distance equal to the diameter of the passageway 34 as illustrated in FIG. 3 with the lower edges 48 being disposed substantially below the bottom portion of the passageway 34 thus forming an inverted U-shaped channel that is open to the bottom surface of the extension 36 with the inner wall of the slot-like passageway being defined by reference numeral 50 which is perpendicular to the passageway 34 with the wall 52 defining the bottom of the passageway having a nominal width to provide a cylindrical passageway 34 of a relatively short distance.

The discharge ends of the walls 38 and 40 and the web portion 42 are generally perpendicular to the longitudinal axis of the passageway 34 with the bottom corners thereof being rounded as at 54. A diffuser 56 is mounted in the discharge end of the nozzle and includes a mounting plate 58 at its upper end received in a slot-like recess 60 in the web portion 42 and secured therein by pins or other type fasteners 62 to enable assembly of the diffuser and also enable replacement or interchange of the diffuser.

Figure 5:
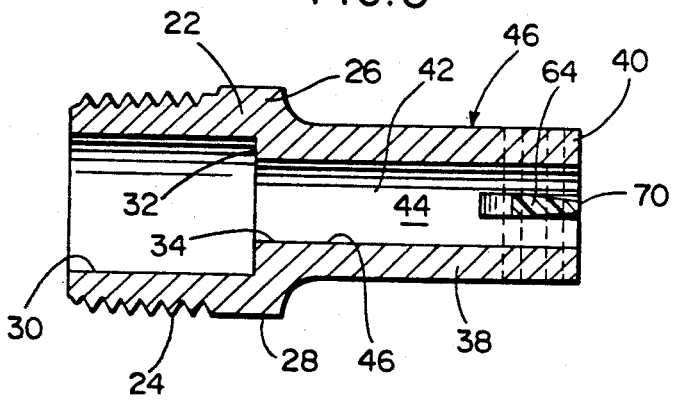
FIG. 5 is a longitudinal, sectional view of the nozzle taken along section line 5—5 on FIG. 4.
Figure 6:
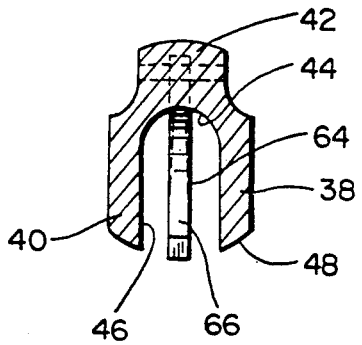
FIG. 6 is a transverse, sectional view taken along section line 6—6 on FIG. 4.

The diffuser 56 is in the form of a curved blade structure having a generally vertically disposed blade member 64 having an arcuately curved edge 66 facing the passageway 34 and an arcuately curved outer lower corner portion 68 generally conforming with the curvature of the end edges 54 of the walls 38 and 40 as illustrated in FIG. 4. The blade 64 includes an upper portion 70 that tapers from a wider edge adjacent the curved edge 66 into a narrow edge at the discharge end of the diffuser with this tapered portion being generally triangular in configuration and tapering from the leading to the trailing edge of the blade 64. The curved edge 66 and the major portion of the blade 64 has parallel side surfaces which are spaced inwardly from the inner surfaces 46 of the walls 38 and 40 as illustrated in FIGS. 5 and 6 with FIG. 5 illustrating the tapered configuration of the upper portion 70 of the diffuser 56.

The nozzle may be constructed of various materials including metals, plastics and the like and can be constructed of different dimensions. The stationary diffuser provides effective diffusion of the liquid stream passing through the passageway 34 to provide an even spray pattern 20. At the present time, two sizes of nozzles have been successfully used in which a nozzle having a capacity of approximately 16½ gals. per minute has a passageway diameter of 0.375" and a nozzle having 22 gals. per minute capacity has a passageway diameter of 0.437". The ratio of diamater to the gallons per minute discharged will be substantially constant with the nozzles capable of discharging a pattern of approximately 20' width on both sides of a tractor thereby enabling two 20' booms to be replaced. The nozzle can be used to apply fertilizer or various other materials to a surface and has also been used to apply growth retardant along road right-of-ways to retard the growth and thus reduce the mowing operations necessary to keep the grass, weeds and the like along the road right-of-way at an acceptable height thereby effectively saving time and labor. When used as a growth retardant spray, the nozzle can be mounted on the side of a truck that moves along the road right-of-way at a substantial speed. The nozzle can also be used to spray orchards by being angled upwardly depending upon the height characteristics of the orchard trees.

Figure 7:
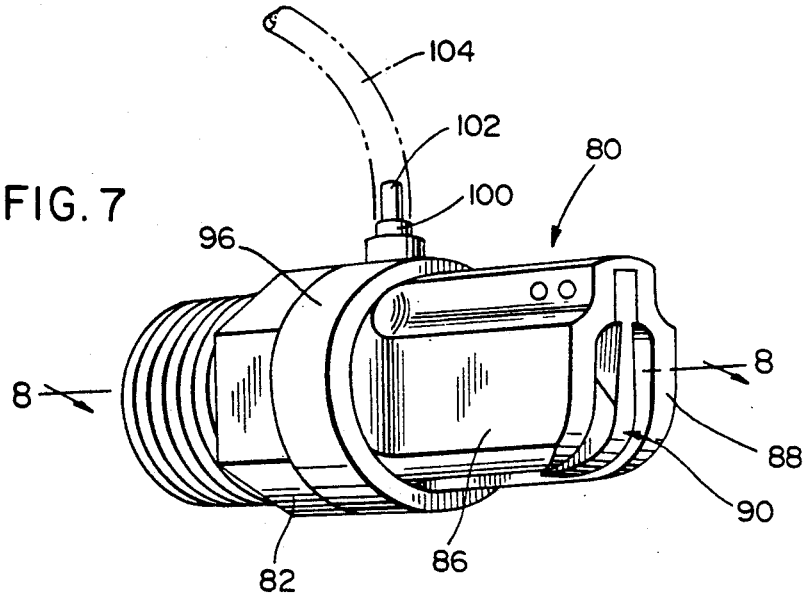
FIG. 7 is a perspective view of the nozzle with an additive injector structure incorporated therein.
Figure 8:
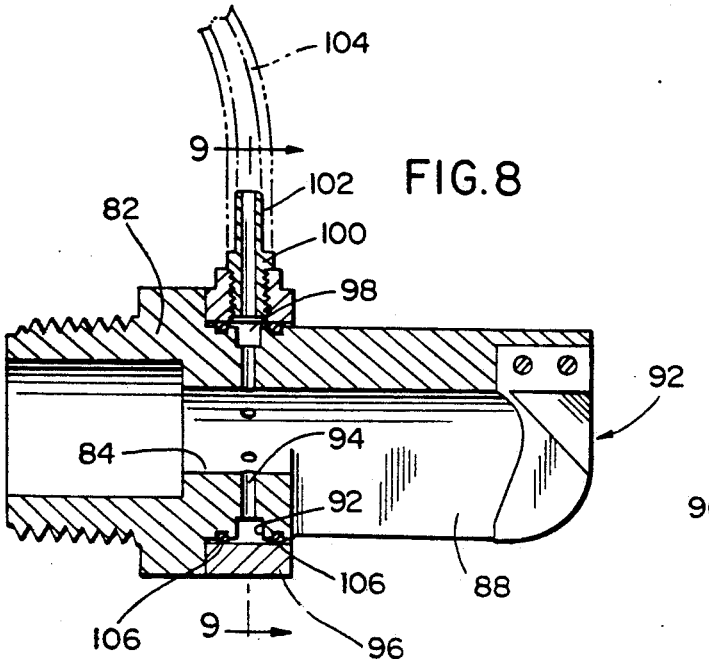
FIG. 8 is a longitudinal, sectional view taken along section 8—8 line on FIG. 7 illustrating the structural details of this embodiment of the invention.
Figure 9:
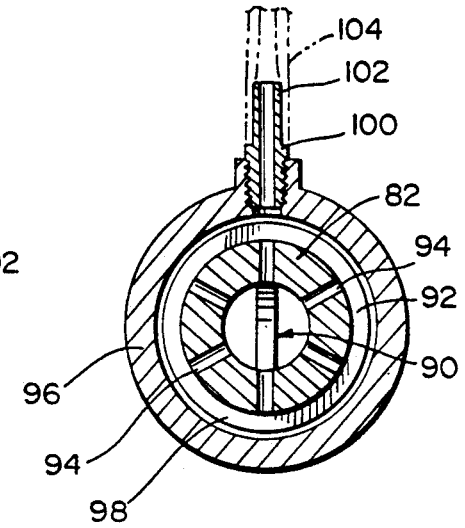
FIG. 9 is a transverse, sectional view taken along section line 9—9 on FIG. 8 illustrating further structural details of the additive injector nozzle.

The nozzle with additive injector illustrated in FIGS. 7–9 is generally designated by reference numeral 80 and includes a body 82 and passageway 84 together with walls 86 and 88 forming an extension thereof and a diffuser 90 associated with the inner surface of the walls 86 and 88 in the same manner as the structure illustrated in FIGS. 1–6. In this embodiment, the body 82 is provided with a cylindrical external recess or manifold 92 having a plurality of radial passageways 94 formed therein which communicate the exterior of the manifold 92 with the passageway 84 which is slightly longer than the passageway 34 in the embodiment illustrated in FIGS. 1–6. A manifold ring 96 of cylindrical configuration closely encircles and rotatably engages the manifold 92 with the inner surface of the manifold ring 96 being spaced from and rotatable in relation to the manifold 92 with the space being designated by reference numeral 98 and forming an annular manifold space in communication with all of the radial passageways 94 thereby enabling injection of liquid material from the manifold space 98 through the passageways 94 into the longitudinal passageway 84. A screw threaded fitting 100 is mounted in the manifold ring 96 at one location therein with the inner end of the fitting 100 communicating with the manifold space 98. The fitting 100 includes an extension 102 to which a flexible hose 104 may be connected in a sealed manner to discharge additive material into the manifold space 98. The surface of body 82 is provided with a pair of spaced O-rings 106 adjacent each edge of manifold 92 to seal the manifold ring 96 in relation to the manifold 92 thereby preventing leakage of additive material from the manifold space 98 but yet permitting the manifold ring 96 to be oriented in any desired angular relation and also enabling the manifold ring 96 to be moved longitudinally for disassembly to enable cleaning and the like when necessary by overcoming the frictional engagement of the O-rings 106 with the interior surface of the manifold ring 96.

The threaded connection of the nozzle 80 to a supply pipe or tee fitting is the same as that illustrated in FIGS. 1–6 and the structure of the inverted U-shaped passageway defined by the walls 6 and 88 and the diffuser and mixer structure 90 also is the same as that illustrated in FIGS. 1–6.

This type of nozzle is especially useful in arrangements in which an area to be provided with an application of fertilizer or other liquid material is surveyed by an aerial infrared survey to determine organic material present in the soil. This type of operation enables a computer control responsive to the survey to introduce varying quantities of added material which normally is introduced at the inlet of a boom. As a spray vehicle travels at a relatively high speed across the area being sprayed, there is a time lag between the time the computer indicates a change in the additive material until the change actually occurs since the change in additive material must move outwardly through the boom to the individual spray nozzle before it actually is discharged thus introducing errors in the application rate as determined by the survey. With this additive injector, the additive material is actually injected at the nozzle thereby providing an accurate control for the quantity of additive material injected into the liquid spray thereby producing a highly accurate control for varying the rate of additive material injected into the liquid being discharged and mixed therewith by the diffuser 90. The manifold ring extends completely around the body thus enabling the ring to rotate 360° for mounting the nozzle at any position with the supply tube positioned at any point around the circumference. The manifold ring is also easily removable for cleaning and servicing.

As indicated, the infrared survey is used to determine soil organic matter and whether more or less herbicide or other additive material is necessary. However, rather than the chemicals being injected into the suction side of a pump with considerable lag before rate change gets to the nozzles on a boom which is travelling at a reasonably high rate of speed resulting in substantial inaccuracies, the nozzle disclosed herein injects the additive directly into the nozzle thus providing instantaneous chemical rate changes as directed by a controlling computer.

In the embodiment illustrated in FIGS. 7–9, as water travels from the large nozzle cavity into the smaller orifice or passageway 84, the water accelerates rapidly and lowers the pressure in the nozzle orifice. In the use of this device, the water pressure may go from 40 PSI in the nozzle cavity to near 0 PSI as it passes the injector tubes 94. This makes it possible to inject chemicals with relatively simple low pressure pumps. This construction also injects the chemicals all the way around the stream of water through the passageways 94 for more complete mixing. The diffuser will evenly distribute the water along a narrow band and also acts to further mix and blend the chemicals as the stream flows past the diffuser. With the manifold ring in place, the chemical enters the chemical injector into the manifold through the injector tube or tubes and into the stream of water. While this structure has some attributes of a venturi, it is not a true venturi because it has no convex constrictor normally found in venturi systems. Even though this nozzle is not designed to self-feed, it will do so if the chemical container is raised above - level so that, in this condition, gravity and a near 0 psi water pressure as it passes the injector tubes will cause the nozzle to self-feed.

The inverted U-shaped construction of the discharge portion of the nozzle from the passageway or orifice to the end of the nozzle is extremely important to provide the accurate pattern of discharge. The width of the discharge area remains the same as the diameter of the passageway or orifice. However, the length of the discharge area may vary. The radius of the leading edge of the diffuser serves to pool the water and does not act as a full radius or true half-circle. The width of the diffuser is commensurate with the diameter of the passageway and the double angle taper at the upper edge of the diffuser to the trailing edge causes a vacuum to be created in the area as the water exits the nozzle. This creates a turbulence in the stream which breaks the water droplets up for better distribution and coverage. In describing the function of the diffuser, it is pointed out that as the liquid comes in contact with the curved face 66 of the diffuser 56, that portion in contact with the curved face is directed downward around the curved face of the diffuser and discharged toward the rear of the nozzle to facilitate overlapping of the spray pattern from the opposite nozzle. However, that is not the only function of the radius or curve of the diffuser. While the portion of liquid in contact with the curved face of the diffuser travels in a downward direction, the portion of liquid on either side of the diffuser attempts to continue its travel past the diffuser in a straight line.

At this point, there is a confined liquid flowing in two directions at a high velocity. This creates a shearing effect between the two. This shearing effect created by the liquid flowing in a downward and circular direction around the face of the diffuser causes a portion of the liquid passing on either side of the diffuser to be drawn down also.

The size and depth of the radius in the diffuser in combination with the width of the diffuser determines the distribution pattern of the liquid for a given orifice size. By changing this combination as described above, the pattern can be shifted from heavy to light on either end or the same from end to end.

The dimensions of a nozzle having a 0.375" passageway includes a diffuser that has a radius of 0.250" on the leading edge with the lower end thereof being inclined at an angle approximately 50° to 60° from vertical. The thickness of the blade may be 0.109 at the leading edge and the rear edge of the tapered portion may be 0.020 and the trailing radius may be 0.406. The overall length of the mounting portion of the diffuser may be 0.480 and the overall height of the diffuser from the upper edge to the lower edge may be 0.925. With the space between the inner surface of the walls being 0.375 which is the same as the diameter of the passageway 34, the space between the surfaces of the diffuser at the lower end portion thereof will be 0.132". The thickness of the wall 52 may be 0.10 and the overall length of the discharge portion of the nozzle designated by numeral 36 may be 1.450. As illustrated, the walls 38 and 40 may have a notched upper surface and an inwardly curved lower edge. However, this is not critical to operation of the nozzle.

The material preferred for the nozzle body is stainless steel and the material preferred for the diffuser is a plastic material such as nylon or the like. The nozzle may be used for applying various materials to road right-of-ways, power line right-of-ways, orchards, fields to be planted or cultivated and wherever it is desired to discharge a spray pattern having even distribution of material in each increment of the spray pattern.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A spray nozzle for attachment to a supply of pressurized liquid comprising a body having a passageway communicating with the supply of pressurized liquid, a discharge extension on said body formed by a pair of spaced generally parallel walls with the spacing between the walls being generally equal to the diameter of the passageway, said walls having an upper edge interconnected by a web portion and an open lower edge forming a slot-like structure, a diffuser positioned between the ends of the walls remote from the passageway for breaking up the flow of liquid into droplets and causing the droplets to be evenly distributed over a lateral path to enable equal material to be discharged on each increment of the lateral path, said diffuser being in the form of a blade stationarily mounted form the web portion of the extension and extending downwardly in equally spaced relation to the interior wall surfaces of the spaced walls, said blade terminating in a lower edge generally aligned with the lower edges of said walls, said blade having an arcuately curved leading edge facing the passageway to pool water in front of the blade to cause the water to pass over the blade and between the blade and walls and to break into droplets.

2. The structure as defined in claim 1 together with a manifold ring mounted on the body, said body including a plurality of radial passages communicating the interior of the manifold ring with the passagway, said manifold ring being sealed and spaced from the exterior of the body to communicate with all of the passages, supply means for additive material connected with the manifold ring and supplying additive material to the space between the manifold ring and the body for discharge into the passageway when liquid is passing through the passageway.

3. The structure as defined in claim 1 together with means injecting a liquid additive into the passageway, said means comprising a peripheral manifold means on said body, additive supply means communicated with said manifold means and a pluality of passages in said body communicating the manifold means with the passageway for injecting liquid additive into the passageway for mixing with liquid flowing through the passageway.

4. The structure as defined in claim 3, wherein said manifold means includes a circumferentially extending recess in the periphery of the body, a peripheral manifold ring in sealed relation to the body and recess, said additive supply means being in communication with said recess, said passages being in the form of a plurality of equally spaced radially extending passages in the body, said passages communicating the recess with the passageway for discharge of generally equal quantities of additive material into the passageway at equally spaced points around the periphery thereof.

5. A spray nozzle for attachment to a supply of pressurized liquid comprising a body having a passageway communicating with the supply of pressurized liquid, a discharge extension on said body formed by a pair of spaced parallel walls with the spacing between the walls having a dimension substantially equal to the diameter of the passageway, said walls having an upper edge interconnected by a web portion and an open lower edge forming a slot-like structure, a diffuser positioned between the ends of the walls remote from the passageway for breaking up the flow of liquid into droplets and causing the droplets to be evenly distributed over a lateral path to enable equal material to be discharged on each increment of the lateral path, said diffuser being in the form of a blade stationarily mounted from the web portion of the extension and extending downwardly in equally spaced relation to the interior wall surface of the spaced walls, said diffuser having an arcuately curved leading edge facing the passageway to pool water in front of the diffuser to cause the water to pass over the diffuser and break into droplets, said diffuser including a tapered trailing edge portion with converging surfaces converging toward the trailing edge and converging upwardly to vary the size of droplets of liquid thereby controlling the trajectory of the droplets for even distribution over the lateral path.

6. The structure as defined in claim 5 wherein said tapered portion of the diffuser extends from the web portion downwardly to a mid-portion of the walls.

7. The structure as defined in claim 6 wherein said diffuser and said walls have arcuately curved lower corners at the discharge ends thereof.

8. The structure as defined in claim 7 wherein the lower edges of the walls extend below the bottom portion of the passageway with the upper portion of the walls being tangential to the opposed edges of the passageway and the inner surface of the web portion defining a continuation of the passageway thereby providing an open inverted U-shaped discharge slot with the upper portion thereof forming a continuation of the passageway.

9. The structure as defined in claim 5 wherein said curved leading edge of the diffuser causes liquid coming into contact therewith to be directed downwardly with a portion thereof discharged toward the end of the nozzle connected with the supply of pressurized liquid, said blade also directing liquid flow around each side surface thereof with both flow paths of the liquid being confined by the interior surfaces of the spaced walls thereby producing a shearing effect between the two flow paths to form a discharge pattern that deposits an equal amount of liquid in each increment of the discharge pattern.

10. A spray nozzle for attachment to a supply of pressurized liquid comprising a body having a passageway communicating with the supply of pressurized liquid, a discharge extension on said body formed by a pair of spaced parallel walls with the spacing between the walls having a dimension substantially equal to the diameter of the passageway, said walls having an upper edge interconnected by a web portion and an open lower edge forming a slot-like structure, a diffuser positioned between the ends of the walls remote from the passageway for breaking up the flow of liquid into droplets and causing the droplets to be evenly distributed over a lateral path to enable equal material to be discharged on each increment of the lateral path, and a manifold ring mounted on the body, said body including a plurality of radial passages communicating the interior of the manifold ring with the passageway, said manifold ring being sealed and spaced form the exterior of the body to communicate with all of the passages, supply means for additive material connected with the manifold ring and supplying additive material to he space between the manifold ring and the body for discharge into the passageway when liquid is passing through the passageway, said manifold ring including a fitting connected to a supply tube and a pair of O-ring seals positioned between the manifold ring and the body to enable rotation of the manifold ring to orient the fitting in any desired position and enable removal of the manifold ring for replacement or repair.

11. The structure as defined in claim 10 wherein said body includes a large cavity forming an entrance to the passageway whereby pressurized liquid will increase in velocity and reduce in static pressure as it passes the inner ends of the radial passages to facilitate injection of additive material around the periphery of the stream of liquid passing through the passageway for thoroughly mixing the additive material with the material passing through the passageway with the diffuser further mixing the materials together.

12. The structure as defined in claim 11 wherein said diffuser is in the form of a blade stationarily mounted from the web portion of the extension and extending downwardly in equally spaced relation to the interior wall surface of the spaced walls, said diffuser having an arcuately curved leading edge facing the passageway to pool water in front of the diffuser to cause the water to pass over the diffuser and break into droplets, said diffuser including a tapered trailing edge portion with surfaces converging toward the trailing edge and converging upwardly to vary the size of droplets of liquid thereby controlling the trajectory of the droplets for even distribution over the lateral path.

13. The structure as defined in claim 11 wherein said diffuser and said walls have arcuately curved lower corners at the discharge ends thereof, the lower edges of the walls extending below the bottom portion of the passageway with the upper portion of the walls being tangential to the opposed edges of the passageway and the inner surface of the web portion defining a continuation of the passageway thereby providing an open inverted U-shaped discharge slot with the upper portion thereof forming a continuation of the passageway.

14. The structure as defined in claim 12 wherein said curved leading edge of the diffuser causes liquid coming into contact therewith to be directed downwardly with a portion thereof discharged toward the end of the nozzle connected with the supply of pressurized liquid, said blade also directing liquid flow around each side surface thereof with both flow paths of the liquid being confined by the interior surfaces of the spaced walls thereby producing a shearing effect between the two flow paths to form a discharge pattern that deposits an equal amount of liquid in each increment of the discharge pattern.

15. In combination with a spray nozzle including a body having a passageway therethrough adapted to be communicated with a supply of pressurized liquid, means for reducing the pressure of said pressurized liquid to near 0 psi in the passageway, said means including said passageway having a constant diameter throughout its length, means for injecting an additive into the near 0 psi liquid as it passes through the constant diameter passageway for mixing with the liquid passing through the passageway, said means comprising a source of additive at low pressure and at least one passage in said body communicating the source of additive with the near 0 psi liquid passing through the constant diameter passageway for injection of additive into the near 0 psi liquid passing through the passageway for mixing therewith.

16. The combination as defined in claim 15 wherein said body includes a manifold means disposed in circumferential relation to said body and in communication with said source of additive, a plurality of passages in said body communicating the manifold means with the constant diameter passageway for injecting additive into the liquid passing through the passageway.

17. The combination as defined in claim 16 wherein said manifold means includes a peripheral external recess in said body, a manifold ring extending circumferentially of said recess in sealed relation to the body and recess, said additive source being communicated with said recess, said passages extending radially from said recess to the passageway and being equally sized and equally spaced to inject an equal quantity of additive into the passageway at equally spaced circumferential areas for mixing with liquid passing through the passageway.

* * * * *